United States Patent [19]

Hambley

[11] Patent Number: 4,613,287

[45] Date of Patent: Sep. 23, 1986

[54] WAVE OPERATED ENERGY DEVICE

[76] Inventor: Charles C. Hambley, c/o The Evergreen Pier, H.C.R. Box 16195, Merizo, Guam 96916

[21] Appl. No.: 697,083

[22] Filed: Jan. 31, 1985

[51] Int. Cl.[4] ..... F04B 35/00

[52] U.S. Cl. ..... 417/330; 417/100; 60/398

[58] Field of Search ..... 417/330, 100; 290/42, 290/53; 60/398

[56] References Cited

U.S. PATENT DOCUMENTS

| | | | |
|---|---|---|---|
| 430,790 | 6/1890 | Starkenberg . | |
| 610,790 | 9/1898 | Beckers . | |
| 755,728 | 3/1904 | Weems | 417/330 |
| 3,149,776 | 9/1964 | Parrish . | |
| 3,685,291 | 8/1972 | Fadden, Jr. | 417/100 X |
| 3,983,404 | 9/1976 | Sherrard | 290/42 X |
| 4,013,379 | 3/1977 | Bolding | 417/330 |
| 4,022,549 | 5/1977 | Gregg | 417/100 |
| 4,172,689 | 10/1979 | Thorsheim | 60/398 X |
| 4,231,711 | 11/1980 | MacGregor | 417/100 |
| 4,281,257 | 7/1981 | Testa et al. | 290/42 |

*Primary Examiner*—Richard E. Gluck
*Attorney, Agent, or Firm*—Henderson & Sturm

[57] ABSTRACT

A wave-powered, two-stage compressed air apparatus (10) comprising a low compression valving arrangement, and a high compression chamber (16), wherein volunteer air is used in the low compression mode to pre-charge the high compression chamber (16) and then kinetic wave energy is subsequently transmitted to a compression piston (21) via the wave (11) impacting a ram disc plate (17).

8 Claims, 4 Drawing Figures

WAVE OPERATED ENERGY DEVICE

TECHNICAL FIELD

This invention relates generally to apparatus that convert normally wasted ocean wave energy into useful energy.

BACKGROUND OF THE INVENTION

This invention relates to the mechanisms for deriving power from the ocean's waves.

Many proposals in the past have been developed to utilize the ocean's waves for producing energy; as can be seen by reference to U.S. Pat. Nos 430,790; 610,790; 3,149,776; 3,983,404; 4,013,379; 4,022,549; 4,172,689; and 4,281,257. Most all of these prior art devices have been floating plants with numerous moving parts. Vulnerability due to storms, loss of energy from the whole plant moving up and down with the swell, too many moving parts, not getting the full kinetic energy from each swell and the inability to obtain large continuous volumes of air have made such previous proposals unsuccessful.

BRIEF SUMMARY OF THE INVENTION

This invention is a two stage single wave operated, air entrapment, high compressed air device, mounted within a solid seawall just inside the surfline with its open end seaward of said seawall and exposed to all incoming waves, said seawall retains the sea and parallels the shoreline.

The device is located at ninety degrees to the length of the sea retaining wall and is slightly inclined from its offshore open end, to its inshore closed off end.

Said device is made up of component parts which can be easily disassembled for repair or replacement of parts.

When each incoming wave rushes into the device it forces out all the entrapped air ahead of it. The majority of this entrapped air is forced through a valve and piping system into the devices second stage high compressed air section.

As the wave moves toward the inshore end of the first stage section, it comes in immediate contact with a ram disc plate, and said ram disc plate has a clearance between it and the inside perimeter of the first stage section, said onrushing wave expends virtually its entire kinetic energy against said ram disc plate, thrusting said ram disc plate toward the inshore end of the first stage chamber. The ram disc plate is attached in series to a ram rod and piston, said piston being located within the device's second stage high compressed air section, said high compressed air section's piston is thrust shoreward along with said ram disc plate, and in turn compresses all air within the high compressed air section. Said compressed air is allowed to release from the high compression section upon reaching a desired pressure through the use of a regulated high compression air release valve. This high compressed air is now a controllable energy source ready for use.

A series of valves, vents, and piping are disposed so as to allow the device to properly recharge its two stages and give off high compressed air. A ram disc plate return spring is provided, which, along with the waves' natural drawback action, return the device to a ready position to accept the next incoming wave and repeat its cycle.

The primary object of this invention is to provide a new method for extracting a controllable energy source from the ocean's waves by utilizing a high compressed air energy source through a mechanism that is totally operated by the ocean's waves.

BRIEF DESCRIPTION OF THE DRAWINGS

These and other objects, advantages and novel features of the invention will become apparent from the detailed description of the best mode for carrying out the invention which follows, when considered in conjunction with the accompanying drawings; wherein.

BEST MODE FOR CARRYING OUT THE INVENTION

Figure 1:
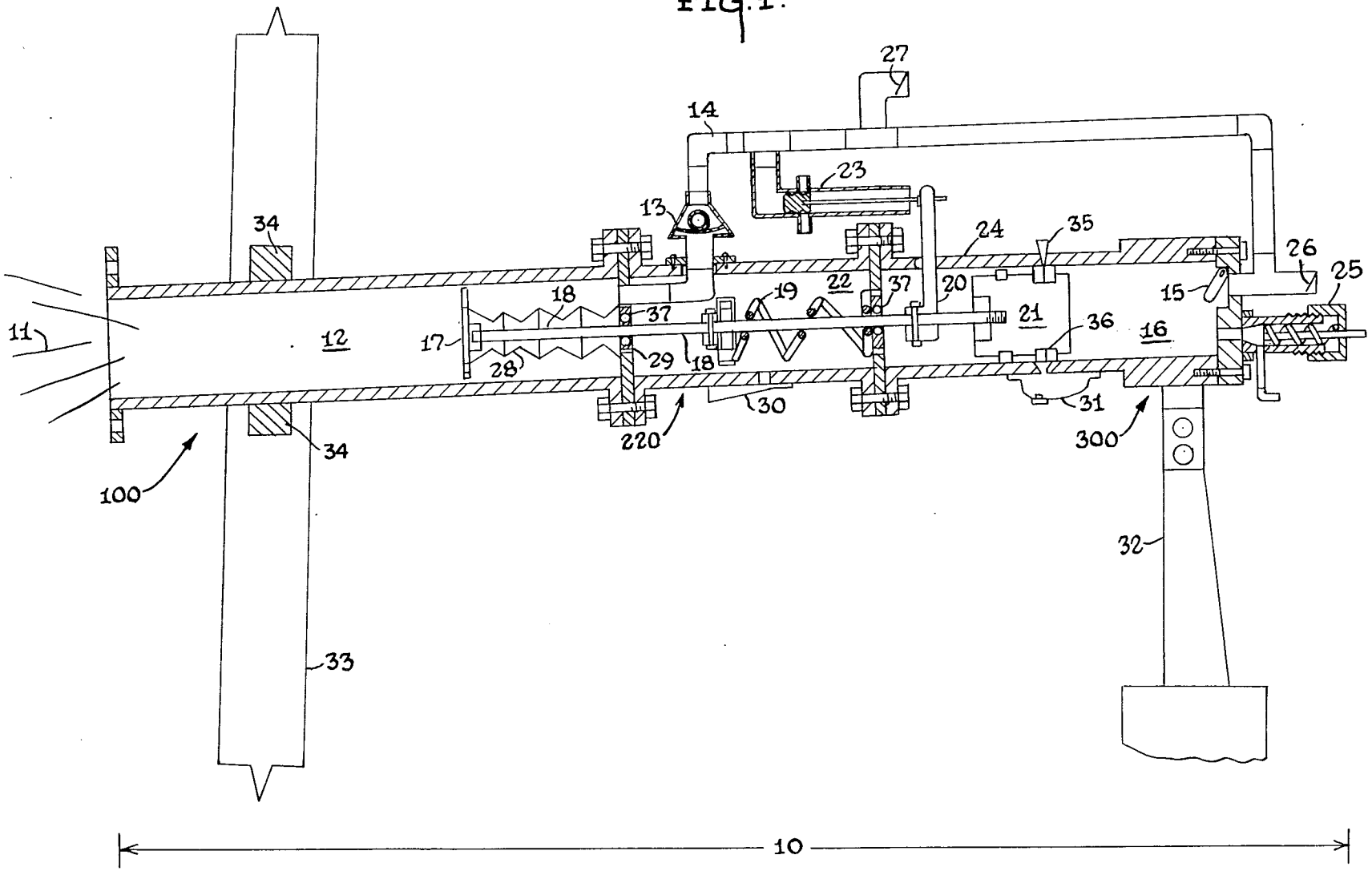
FIG. 1 is a cross-sectional view of the wave operated energy apparatus disposed in its intended environment.
Figure 2:
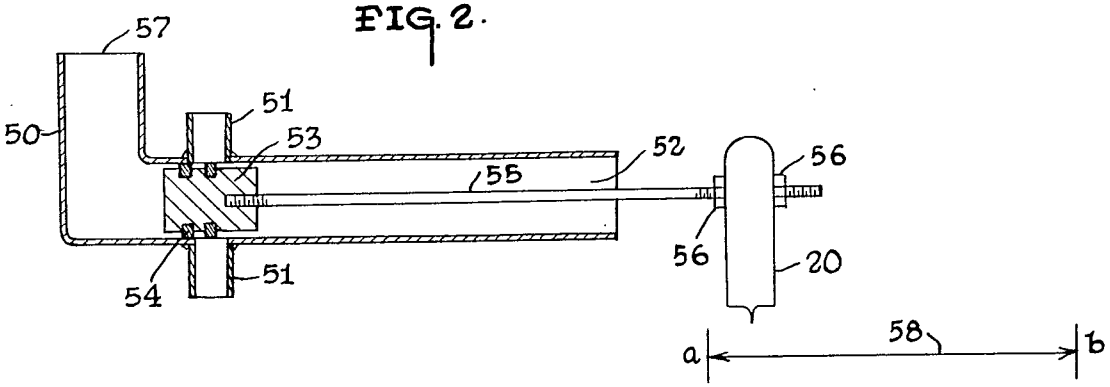
FIG. 2 is a detail view of the vent valve used in the apparatus.

As can best be seen by reference to FIG. 1, the wave operated energy apparatus is designated generally by the numeral 10. The apparatus 10 comprise in general an energy receiving stage designated generally as (100), a low compression volunteer air transfer stage designated generally at (220), and a high compression stage designated generally as (300).

The apparatus (10) relies for its operation upon wave energy; and as can be seen in FIG. 1, the apparatus is disposed generally perpendicular and at a downwardly inclined angle with respect to the direction of on-coming waves (11). In this position, the opening of the generally elongated cylindrical apparatus (10) defines the open end of the first stage chamber (12).

As the wave 11 moves into chamber 12, it forces the entrapped air in front of the wave 11 out through caged ball float check valve (13), through piping 14, through flap valve (15), and into the third stage chamber. In as much as the receding wave from the first stage chamber will be replaced by a like volume of air; this volume of air will be referred to hereinafter as "volunteer air". The volunteer air enters the third stage chamber (16) and precharges chamber 16 with the entrapped air.

As wave (11) fills air entrapment chamber (12), it comes in contact with a ram disc plate (17). Ram disc plate (17) is designed so there is a clearance between its outer perimeter and the inside perimeter of chamber (12). Wave (11) now expends virtually its entire kinetic energy against ram disc plate (17), thrusting ram disc plate (17) toward the inshore end of chamber (12).

The ram disc plate (17) is in turn connected to ram rod (18), which is in turn connected to ram disc plate return spring (19), slide valve lever (20); and piston (21). Piston (21) rides within the high compression cylinder chamber (16). The ram disc plate return spring (19) is located within the ram disc plate return spring chamber (22), and as ram disc plate (17), ram disc plate return spring(19), slide valve lever (20) and piston (21) are thrust toward the shoreward end of their respective chambers: ram disc plate return spring (19) is compressed.

The slide valve lever (20) opens slide valve (23) allowing all remaining entrapped air within the air entrapment chamber (12) to escape into the atmosphere thus eliminating all air blocks within air entrapment chamber (12). Slide valve lever (20) rides within the slide valve lever slot (24), located within the top seaward portion of high compression chamber (16). Piston (21) compresses all air within the shoreward end of the compression cylinder chamber (16). Subsequently said compressed air is then released at a regulated pressure by means of an adjustable air release valve (25). The compressed air is now a controllable high energy source ready for use.

As wave 11 recedes, or is drawn back by the rise of the next incoming wave, ram disc plate return spring (19) returns piston (21), ram rod (18), ram disc plate (17) to the ready position awaiting the next incoming wave and closes off slide valve (23). Flap valves (15), (26), (27), and the ball float caged check valve (13), allows air to recharge chambers (12) and (16) upon the movement of the apparatus to its ready position and bellows (28) maintains water tight integrity around ram rod (18).

Breathing hole (29) allows the inside area of bellows (28) to breathe, and a vent (30) allows air ingress and egress within chamber (22). Piston sump (31) allows the collection of lubricating oil which has drained from piston (21). Back brace (32) braces the shoreward end of the unit. A typical concrete seawall (33) holds out the sea and secures the front section of the entire unit by embedding the unit's steel hangers (34) and an outside portion of chamber (12) within the concrete seawall (33).

Oil cup (35) allows for the lubrication of piston (21). Piston rings (36) provide piston (21) with a compression seal. Ram rod (18) is mounted within the center of the shoreward ends of chambers (12) and (22) by sealed self-lubricated ball bearings, which allow ram rod (18) to operate smoothly. With a seaward cover plate placed over the seaward end of chamber (12), the unit can be completely disassembled for repair work. Everything described herein, is merely illustrative of the principles involved, and other embodiments may be resorted to.

Figure 3:
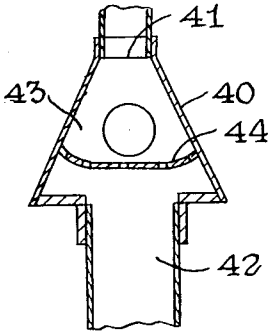
FIG. 3 is a detail view of a float type check valve in the apparatus.

As can best be seen by reference to FIG. 3, valve (13) is comprised of the following: an inverted cone-shaped stainless steel housing (40). Said housing (40) contains two pipefitting openings, a smaller top opening (41), a larger bottom opening (42) a rubber float ball (43) and a dish shaped float ball cage (44).

When said valve (13) contains no water, rubber float ball (43) rests above the larger bottom opening (42) and the rubber float ball (43) rests upon the dish shaped cage (44). When valve (13) is flooded with water, the rubber float ball (43) floats up and closes off smaller top opening (41), thus keeping water from entering said smaller top opening (41). When valve (13) is not flooded with water, said rubber float ball (43) is resting upon said dish shaped cage (44). Then both smaller top opening (41) and larger bottom opening (42) are open, and thus allow passage of air from either direction, top to bottom or vice versa.

Valve (23) is comprised of the following: a cyclinder shaped housing (50), wherein the housing (50) contains four openings. The smaller pair are the air escape openings (51) and the second larger pair of openings serve two different purposes. Opening (52) is to allow a slide valve piston (53), piston rings (54), and piston rod (55), to move within said cylinder shaped housing (50). Said piston rod (55) is connected to lever (20) by passing through a hole in the upper end of lever (20), and is secured with two lock nuts (56).

Cylinder shaped housing (50) has its fourth opening (57) at the opposite end of said opening (52). Opening (57) allows trapped air within its opening to enter said cylinder shaped housing (50) and upon movement of said lever (20) from point "a" to point "b", as shown (58). Said piston rod (55), and piston (53) move in unison with said lever (20), and allow entrapped air to escape through said air escape opening (51). Upon return of lever (20) from point "b" to point "a", the piston rod (55) and piston (53), moving in unison with said lever (20) close off said air escape openings (51) and in turn close valve. (23).

Figure 4:
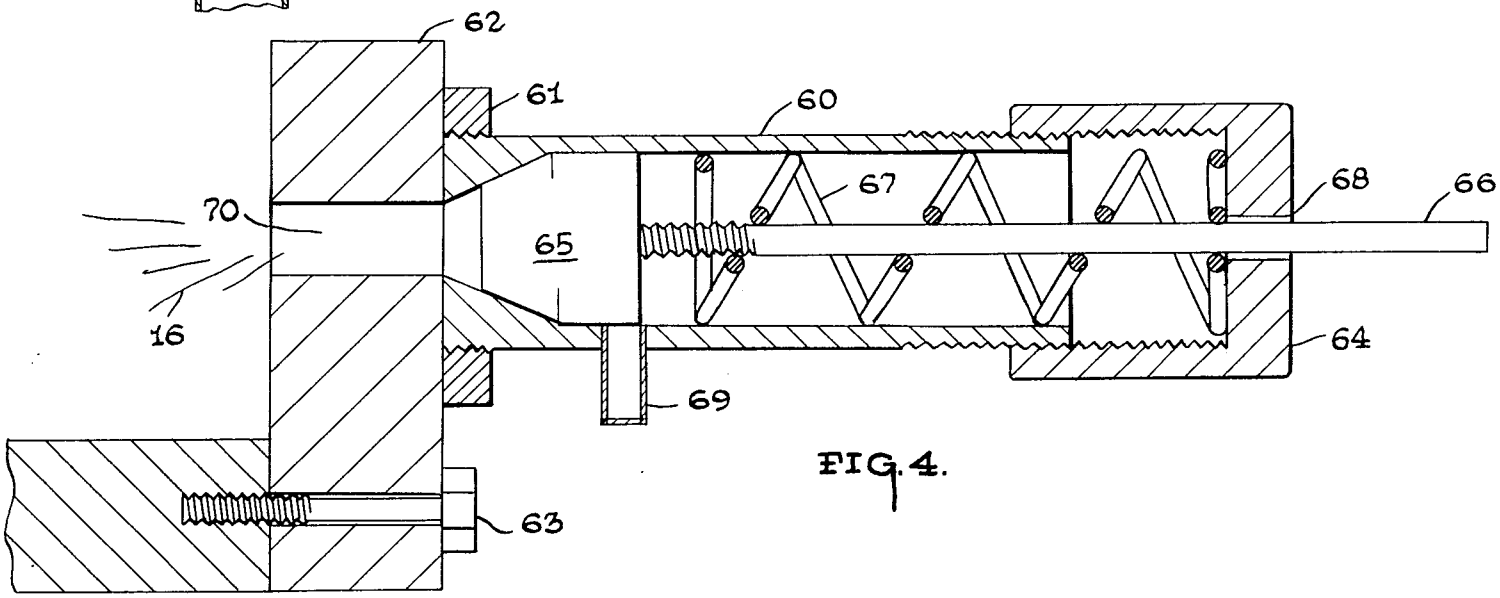
FIG. 4 is a detail view of the output pressure regulating valve used in the apparatus.

As can best be seen in FIG. 4, valve (25) is comprised of the following: a cylinder shaped housing (60) secured by threads to a threaded flange (61) which is welded to cylinder head (62) which is bolted to the main apparatus by bolt (63). Cylinder shaped housing (60) is comprised of a screw down cap (64), a cone shaped piston (65), a piston guide rod (66), a pressure spring (67), a piston guide rod bushing (68) and a high pressure air release port numberal (69).

As high compressed air within high compression cylinder chamber (16) reaches a set pressure; it moves said cone shaped piston (65) away from high compression cylinder's compressed air release opening (70); and in turn, moves piston guide rod (66), and compression pressure spring (67). As cone shaped piston (65) moves past high pressure air release port (69), it allows the compressed air, which has reached the designated pressure, to escape through said high pressure air release port (69). The desired pressure is obtained by adjusting screw down cap (64). For increased pressure screw down cap (64) is tightened. For decreased pressure screw down cap (64) is loosened. When the set pressure falls below its desired strength, the pressure spring (67) forces cone shaped piston (65) against high compressed air release opening (70) in turn closing off high pressure air release port (69) and closing valve (25).

Having thereby described the subject matter of this invention, it should be obvious that many substitutions, modifications and variations of the invention are possible in light of the above teachings. It is therefore to be understood that the invention as taught and described herein, is only to be limited to the extent of the breadth and scope of the appended claims.

What I claim is:

1. A wave operated energy apparatus, comprising;

a generally elongated cylindrical first stage energy receiving chamber, having an outwardly biased ram disc positioned in its forward section and exposed to oncoming waves, and a high compression piston formed in its rearward section, wherein the ram disc and high compression piston are operatively connected via an elongated ram rod;

a high compression stage comprising a high compression chamber, in which the said high compression piston is slidingly disposed, wherein the rearward face of the said piston defines the forward wall of the said high compression chamber and said high compression chamber has an inlet and an outlet; and piping between said first stage energy receiving chamber and said high compression chamber, said piping having vent means, and valve means to control said vent means, said piping arranged to allow passage of air entrapped in front of an oncoming wave to flow around the ram disc and into the rearward end of said high compression chamber.

2. An apparatus as in claim 1, wherein the rearward end of the high compression chamber is provided with an inwardly opening check valve; in fluid communication with said piping and said first stage energy chamber.

3. An apparatus as in claim 2; wherein the said piping is in communication with the rearward end of the high compression chamber and with the rearward face of the ram disc.

4. An apparatus as in claim 3, wherein the end of the piping in communication with the rearward face of the ram disc is provided with a normally open float valve.

5. An apparatus as in claim 4; wherein said vent means and valve means includes at least one vent provided intermediate the ends of said piping.

6. An apparatus as in claim 4; wherein said vent means and valve means includes an inwardly opening vent valve disposed intermediate the ends of said piping.

7. An apparatus as in claim 6; wherein said vent means and valve means includes a sliding vent valve operatively associated with said ram rod, and moves in concent with said ram rod, to uncover a vent port in said piping.

8. An apparatus as in claim 7; wherein the high compression chamber further comprises:

the said outlet port disposed in fluid communication with an adjustable high compression check valve that will open upon the pressure within the said high compression chamber reaching a desired pressure value.

* * * * *